US008096786B2

(12) United States Patent
Bullock

(10) Patent No.: US 8,096,786 B2
(45) Date of Patent: Jan. 17, 2012

(54) THREE DIMENSIONAL MICRO-FLUIDIC PUMPS AND VALVES

(75) Inventor: Lamar E. Bullock, Plymouth, MA (US)

(73) Assignee: University of Massachusetts, North Dartmouth, MA (US)

( * ) Notice: Subject to any disclaimer, the term of this patent is extended or adjusted under 35 U.S.C. 154(b) by 462 days.

(21) Appl. No.: 12/394,070

(22) Filed: Feb. 27, 2009

(65) Prior Publication Data

US 2009/0211643 A1 Aug. 27, 2009

Related U.S. Application Data

(60) Provisional application No. 61/031,957, filed on Feb. 27, 2008.

(51) Int. Cl.
*F04B 43/00* (2006.01)
*F04B 45/00* (2006.01)

(52) U.S. Cl. ..... 417/412

(58) Field of Classification Search ..... None
See application file for complete search history.

(56) References Cited

U.S. PATENT DOCUMENTS

| | | | | |
|---|---|---|---|---|
| 5,029,805 | A * | 7/1991 | Albarda et al. | 251/11 |
| 6,007,309 | A * | 12/1999 | Hartley | 417/322 |
| 6,149,123 | A * | 11/2000 | Harris et al. | 251/11 |
| 6,520,753 | B1 * | 2/2003 | Grosjean et al. | 417/379 |
| 6,767,194 | B2 | 7/2004 | Jeon et al. | |
| 7,143,785 | B2 | 12/2006 | Maerkl et al. | |
| 7,185,542 | B2 | 3/2007 | Bang et al. | |
| 7,235,914 | B2 * | 6/2007 | Richards et al. | 310/328 |
| 7,282,239 | B2 | 10/2007 | Sarigiannis et al. | |
| 7,300,631 | B2 | 11/2007 | Miller et al. | |
| 2002/0168278 | A1 | 11/2002 | Jeon et al. | |
| 2003/0128812 | A1 | 7/2003 | Appleby et al. | |
| 2004/0013536 | A1 * | 1/2004 | Hower et al. | 417/207 |
| 2004/0120836 | A1 | 6/2004 | Dai et al. | |
| 2005/0045238 | A1 * | 3/2005 | Yang et al. | 137/833 |
| 2005/0176135 | A1 | 8/2005 | Jones | |
| 2005/0221529 | A1 | 10/2005 | Bang et al. | |
| 2006/0275852 | A1 | 12/2006 | Montagu et al. | |

FOREIGN PATENT DOCUMENTS

EP 1 208 189 B1 10/2004

(Continued)

OTHER PUBLICATIONS

Bullock, Lamar et al., "Rapid Prototyping and Characterization of Microfluidic Devices with Laser Machining and Advanced Confocal Microscopy", American Biotechnology Laboratory, Jun./Jul. 2006, 3 pages.

(Continued)

*Primary Examiner* — Toan Ton
*Assistant Examiner* — Britt D Hanley
(74) *Attorney, Agent, or Firm* — Vern Maine & Associates

(57) ABSTRACT

A system is disclosed for the control of fluid flow in a micro-fluidic system, the system having: a substrate; at least one micro-fluidic channel having disposed in a microchannel layer atop the substrate; a conformable layer disposed on the micro-fluidic layer; a receiving cavity disposed within the at least one micro-fluidic channel; at least one occluding member disposed within the conformable layer, and configured to be received by the receiving cavity so as to occlude the micro-fluidic channel when depressed by an actuator.

13 Claims, 6 Drawing Sheets

FOREIGN PATENT DOCUMENTS

| | | | |
|---|---|---|---|
| EP | 1 518 822 | A2 | 3/2005 |
| WO | 01/09598 | A1 | 2/2001 |
| WO | 02/053290 | A2 | 7/2002 |
| WO | 02/098624 | A1 | 12/2002 |
| WO | 2004/061308 | A1 | 7/2004 |
| WO | 2006/132666 | A1 | 12/2006 |
| WO | 2007061448 | A2 | 5/2007 |

OTHER PUBLICATIONS

Henderson, David A., "Novel Piezo Motor Enables Positive Displacement Microfluidic Pump", NSTI Nanotech, 2007, 4 pages.

Bullock, Lamar E. et al., "Control of Micro-Fluidic Flow Using 3D Features", Proceedings for Nanotec, May 2007, 4 pgs.

* cited by examiner

THREE DIMENSIONAL MICRO-FLUIDIC PUMPS AND VALVES

RELATED APPLICATIONS

This application claims the benefit of U.S. Provisional Application No. 61/031,957, filed Feb. 27, 2009 and is herein incorporated in its entirety by reference.

STATEMENT OF GOVERNMENT INTEREST

Portions of the present invention may have been made in conjunction with Government funding under Grant number S21052611204000 made by the National Science Foundation and there may be certain rights to the Government.

FIELD OF THE INVENTION

The invention relates to fluid pumping, and more particularly, to a micropump having a three dimensional structure.

BACKGROUND OF THE INVENTION

One important application of micro-fluidics is to make small, automatic measurement instruments, to replace the function of large laboratory instruments that require highly trained and skilled operators. The micro-instrument must precisely meter the sample and reagents required for the analysis, and then thoroughly mix them in preparation for analysis of a very small quantity of material. One significant advantage of the small sample is that both dispersion times and chemical reaction times can be much shorter.

Many researchers have developed techniques to control the flow in micro-circuits. Some related mechanical methods use shape memory metal alloys as actuators, or piezoelectric actuation or voice coils.

Other known micropump technologies include various techniques adapted from MEMs fabrication and other unidimensional techniques. These include: Shape memory alloy micropump—Two TiNi, a material that when heated deflects in a certain direction; actuators are bonded together in opposite orientation. When one is heated up the TiNi actuator deflects downward, when the other is heated while the first one cools the actuator deflects upward. Thermally cycling the two TiNi actuators 180° out of phase will cause the actuator to move up and down continuously.

Valve-less diffuser pump—a single pump chamber and piezoelectric actuation, uses diffusers as flow directing elements that are connected to the pump chamber with an oscillating diaphragm.

Injection molded—uses the conventional construction of a loud speaker where a flexible membrane is moved by an electromagnetic actuator that consists of a magnet that sits in a coil.

Bubble pump—relies on the formation of a vapor bubble in a channel. Uses the surface tension of water to push the fluid through a microchannel.

What is needed, therefore, are techniques for providing a valve and pump suitable for micro-fluidic applications.

SUMMARY OF THE INVENTION

One embodiment of the present invention provides a system for the control of fluid flow in a micro-fluidic system, the system comprising: a substrate; at least one micro-fluidic channel having disposed in a microchannel layer atop the substrate; a conformable layer disposed on the micro-fluidic layer; a receiving cavity disposed within the at least one micro-fluidic channel; at least one occluding member disposed within the conformable layer, and configured to be received by the receiving cavity so as to occlude the micro-fluidic channel when depressed by an actuator.

Another embodiment of the present invention provides such a system wherein the occluding member is of a geometric shape selected from the group of shapes consisting of spheres, cones, oblongs, and ellipsoids.

A further embodiment of the present invention provides such a system wherein the occluding member is configured from a durable material selected from the group of durable materials consisting of steel, ceramic, and engineered plastic.

Still another embodiment of the present invention provides such a system wherein the receiving cavity is configured to match the shape of the occluding member.

Still another embodiment of the present invention provides such a system where the micro-fluidic channel is connected to the receiving cavity with a transition area to control the velocity change of the fluid and reduce the volume of low flow regions (dead zones).

A still further embodiment of the present invention provides such a system wherein the actuator is driven by a cam.

Yet another embodiment of the present invention provides such a system wherein the cam is positioned using a linear motor.

Yet another embodiment of the present invention provides such a system wherein the actuator is a latched binary linear mechanical switch.

One embodiment of the present invention provides a system for pumping micro-fluidic amounts, the system comprising a first, a second and a third valve system disposed upon a common micro-fluidic chamber, such that the first and the third valve systems define a pump chamber, and the second valve system according to provides pressure forcing fluid from the pumping chamber.

One embodiment of the present invention provides a method of pumping micro-fluidic amounts, the method comprising: opening a upstream valve to fill a pump chamber defined by a downstream and the upstream valve in a micro-fluidic channel; sealing the upstream valve by depressing an occluding member in a upstream micro-fluidic receiving cavity disposed in the micro-fluidic channel; opening the downstream valve; depressing a compression valve disposed down stream from the upstream valve and proximal to the upstream valve thereby forcing fluid from the pump chamber; and closing the downstream valve.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 1:
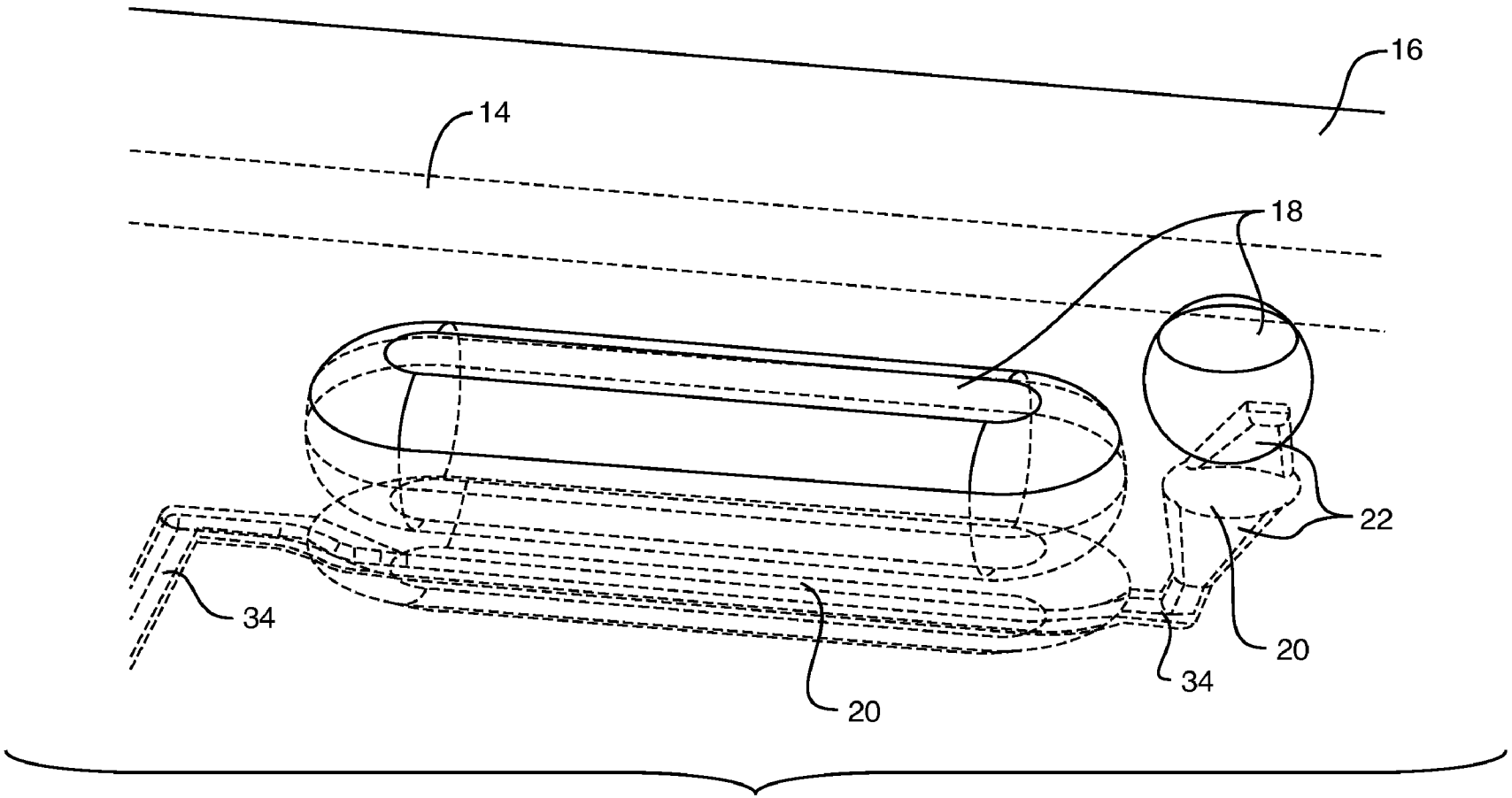
FIG. 1 is a block diagram illustrating a micro-fluidic pump configured in accordance with one embodiment of the present invention.

According to one embodiment of the present invention by machining spherical segments as part of the flow channels mechanical valves and positive displacement pumps can be constructed. The matching spherical surfaces provide optimal sealing of the valves, with minimum displacement of a compliant layer. The transition areas 22 join the flow channels 34 to the spherical surfaces 20 with a controlled change in the cross-sectional flow area. The quantity of fluid displaced with each cycle of the pump is determined by the machined spherical segment 20, which is fully displaced on each cycle. The spherical displacement of the compliant layer, is accomplished by the mechanical depression of steel balls or other occluding member 18 imbedded in the compliant layer, directly above the spherically machined surfaces 20 in the channel plate. One such embodiment uses a linear cam bar to depress the balls 18.

As illustrated in one embodiment of the present invention a micropump 10 is provided having a layered construction and actuator. As illustrated in FIG. 1 a base layer 12 is provided upon which is disposed a microchannel layer 14, configured to permit the flow of reagents and such other fluids, through channels 34, transition areas 22 and spherical surfaces 20 utilized in various embodiments of the present invention. Disposed on the microchannel layer 14 is a compliant layer 16 configured from an elastic, solid material. This material, in one embodiment, is resistant to both chemical and ultraviolet attack. There are many application dependent material considerations. For live cell lab-on-a-chip applications the materials may have to be oxygen permeable and nontoxic to maintain live cells. Many analysis applications require materials that can be surface activated to adhere proteins for specific molecular capture and detection. The precise control and metering capabilities of the present invention will compliment a wide range of these micro-fluidic applications. In one such embodiment, the material selected is optically clear. In one embodiment, this compliant layer 16 is configured with occluding members 18 whereby the channels disposed in the micro-channel layer may be occluded or sealed. Such occluding members 18 may be configured from steel, ceramic, polyetheretherketone, engineered plastics or similar high strength, hard, or easily machined material. The occluding members 18 may be configured to be received by corresponding channel segments 20. The occluding members 18 may be configured as spheres or balls, oblong prisms, or other suitable shapes and should be received by appropriately machined channel segments 20. Considerations dictating various shapes include desired pump volume.

Figure 3:
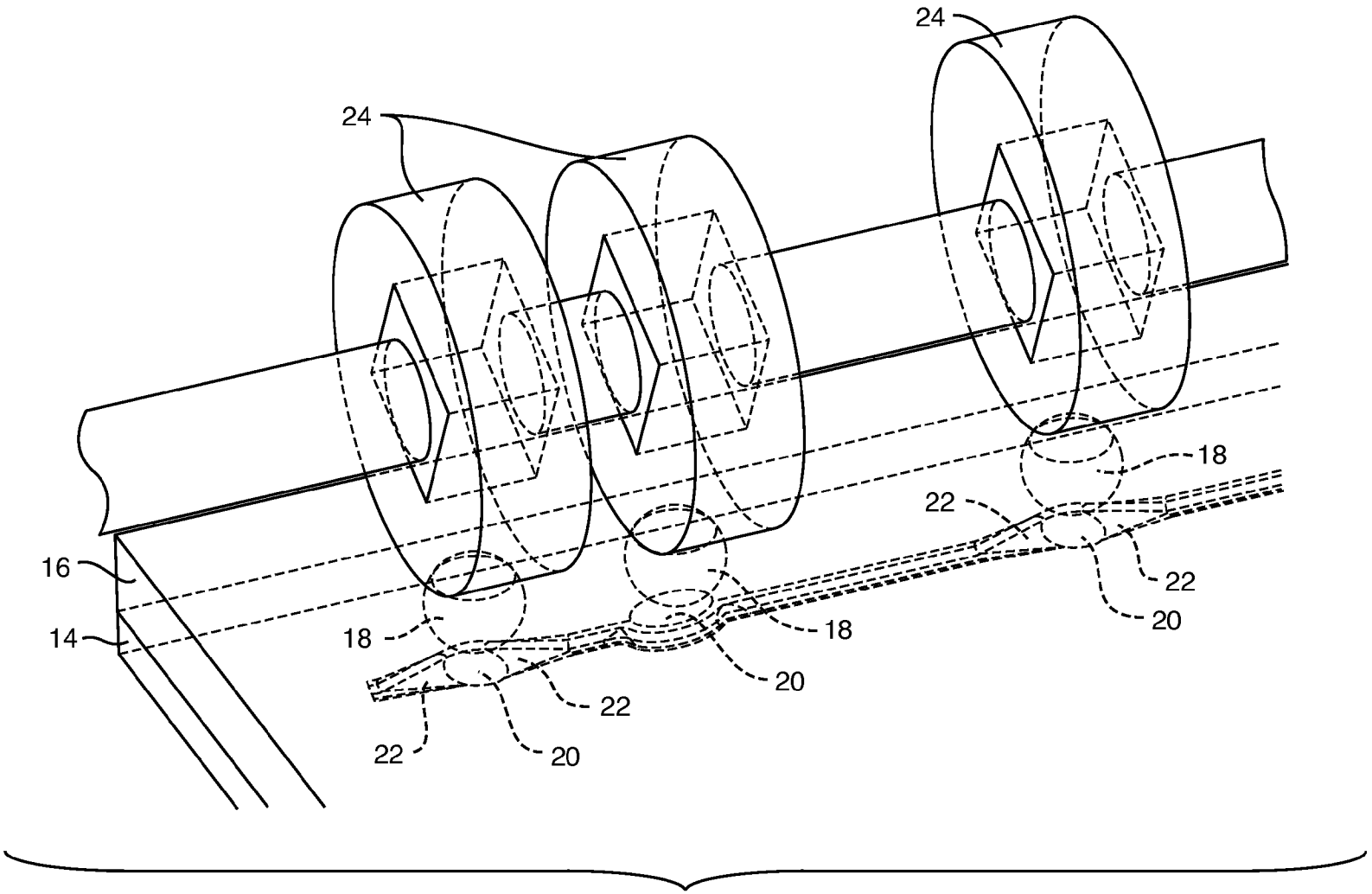
FIG. 3 is a perspective view of a micro-fluidic pump configured in accordance with one embodiment of the present invention and having a cam actuator.

In one embodiment a distinct layer may be provided wherein actuators 24 are disposed whereby the balls of the compliant layer 16 may be actuated. Actuators may include electronic motor driven linear or rotary cams such as those illustrated in FIG. 3 and/or a plurality of independent actuators whereby each ball may be independently actuated. Other actuators include linear motors, such as that sold under the trademark "Squiggle®". The applicant makes no claim to the trademark Squiggle®, a registered trademark of New Scale Technologies, Inc. of New York. One skilled in the art will appreciate that other actuators may be used providing for the linear movement of the occluding members 18 within the spherical channel segments 20. Additional layers to such a pump design may include detector layers or covers. Manufactured from materials suited to the requirements of the system in which the pump 10 is disposed.

In one embodiment the conformable layer 16 is configured from polydimethylsiloxane, a material having the desired properties described above. One skilled in the art will appreciate that other materials having desirable properties for such an implementation may also be employed and would be within the scope of the present invention. Other layers used in the construction may be selected with reference to properties required by the application in which the pump is employed. In one embodiment, where optical clarity, UV resistance, chemical resistance, and high hardness are required, polycarbonate may be employed. Additionally, different layers may be fabricated of different materials, an embodiment with a microchannel layer manufactured from polycarbonate and a conformable layer manufactured from polydimethylsiloxane may have a base and a cover manufactured from aluminum or other material appropriate for a specific application.

In one embodiment of the present invention, a chip, wherein a pump configured in accord with one embodiment of the present invention may be disposed with a thickness less than about approximately 25 mm, with individual layers being between 0.1 and 12 mm. In such an embodiment, microchannel layers may be about approximately 1 mm in thickness. Other layers such as the layer in which the actuator is disposed may be thicker.

The pumping cycle according to one embodiment of the present invention is illustrated in FIGS. 2A-2E. The pump 10 is defined by first 26 and second balls 28 disposed in a compliant layer 16 at opposing ends of a segment of microchannel 30, thus defining the segment of microchannel 30 as a pump chamber. In one embodiment, the balls disposed within the compliant layer 16. Disposed between the first and second ball is at least one additional ball 32. The additional ball 32 is configured to depress a portion of the compliant layer, pressurizing the fluid within the segment of the microchannel 30.

Figure 2A:
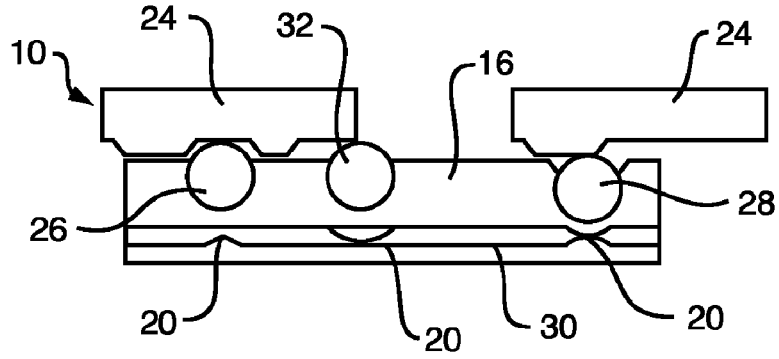
FIG. 2A is a block diagram illustrating a micro-fluidic pump configured in accordance with one embodiment of the present invention in a priming configuration.
Figure 2B:
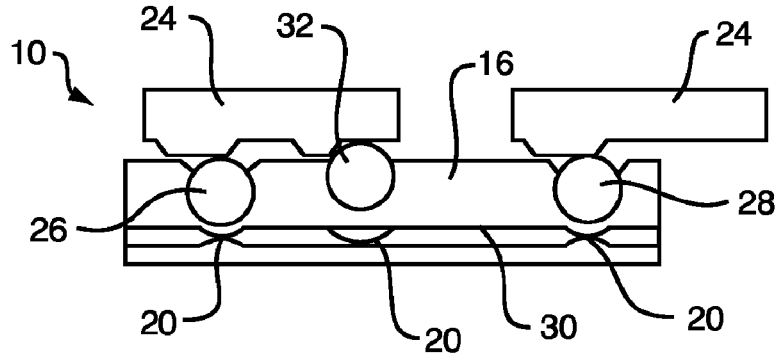
FIG. 2B is a block diagram illustrating a micro-fluidic pump configured in accordance with one embodiment of the present invention in a sealing configuration.
Figure 2C:
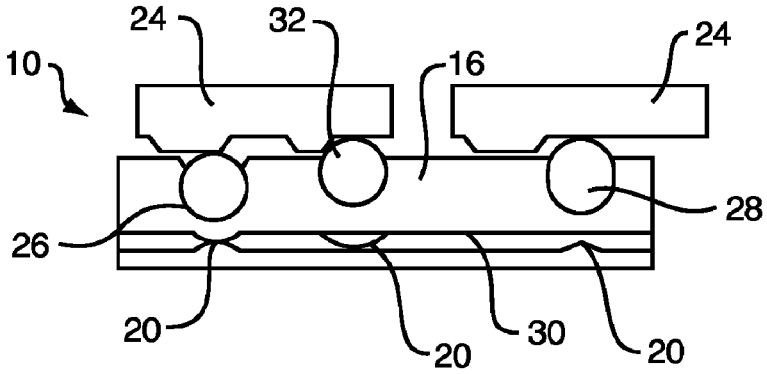
FIG. 2C is a block diagram illustrating a micro-fluidic pump configured in accordance with one embodiment of the present invention in a ready configuration.
Figure 2D:
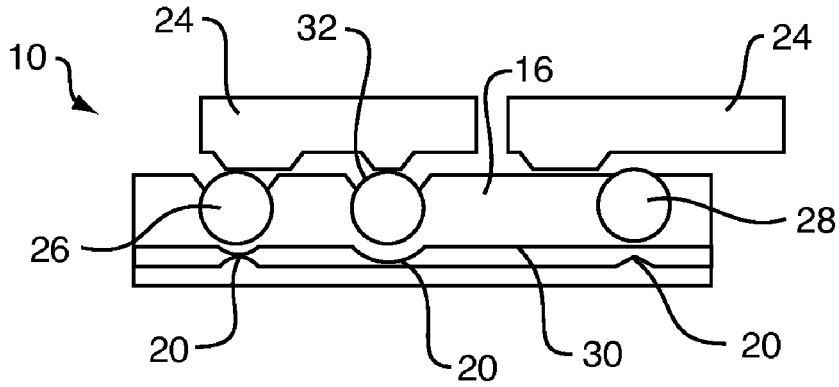
FIG. 2D is a block diagram illustrating a micro-fluidic pump configured in accordance with one embodiment of the present invention in a pumping configuration.
Figure 2E:
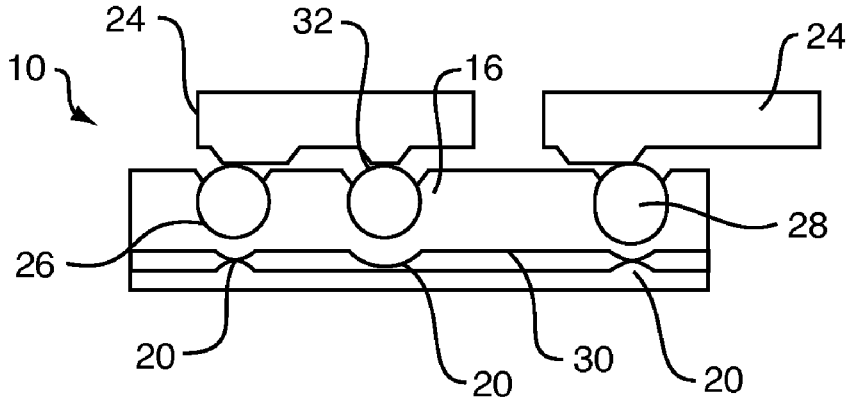
FIG. 2E is a block diagram illustrating a micro-fluidic pump configured in accordance with one embodiment of the present invention in a closed configuration.
Figure 4:
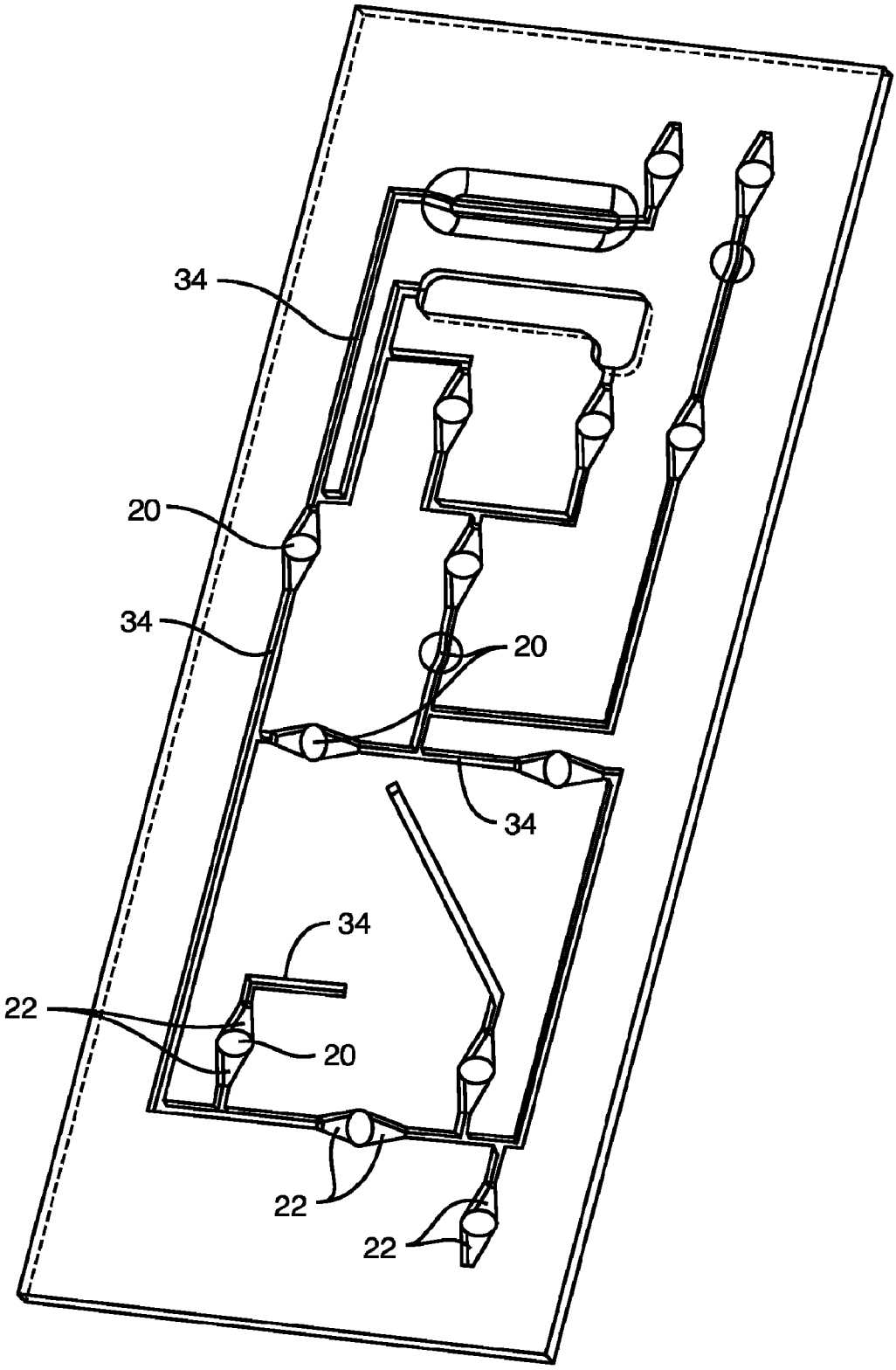
FIG. 4 is a perspective view illustrating a micro-fluidic system having valves configured in accordance with one embodiment of the present invention in a closed configuration.

In FIG. 2A the first step the pump is primed by opening microchannels upstream of the desired flow and the closure of a downstream microchannel, allowing the fluid to fill the microchannel within the pump. The opening of the microchannels is achieved by permitting the ball and compliant layer to lift, while depression of the ball forces the compliant layer 16 against the wall and bottom of the spherical channel segment 20, effectively closing the channel. Such a ball, spherical channel segment and compliant layer configuration can be described as a valve. As illustrated in FIG. 2B, the microchannel is closed at the extreme upstream end of the pump while the downstream end of the pump remains closed. As illustrated in FIG. 2C, the downstream valve is opened allowing fluid to flow downstream. FIG. 2 D illustrates the compression of the additional ball 32, forcing the fluid to flow through out through the downstream channel. Finally, as illustrated in FIG. 2 E, the downstream valve is closed to prevent the fluid from backing up into the pump chamber. On skilled in the art will readily appreciate that this is scalable to include other configurations with a plurality of inflow and outflow ports or additional pressure inducing occluding members One embodiment of the present invention, illustrated in FIGS. 4 and 5, relates to a lab-on-a-chip test design. A mini-scale test circuit illustrated in FIG. 4 was machined to test the operation of the valves and pumps. This device was designed so that each section of the circuit can be flushed to clean the channels 34, a reagent can be added to the sample and the fluids can be circulated to mix and fully react the chemicals.

Figure 5:
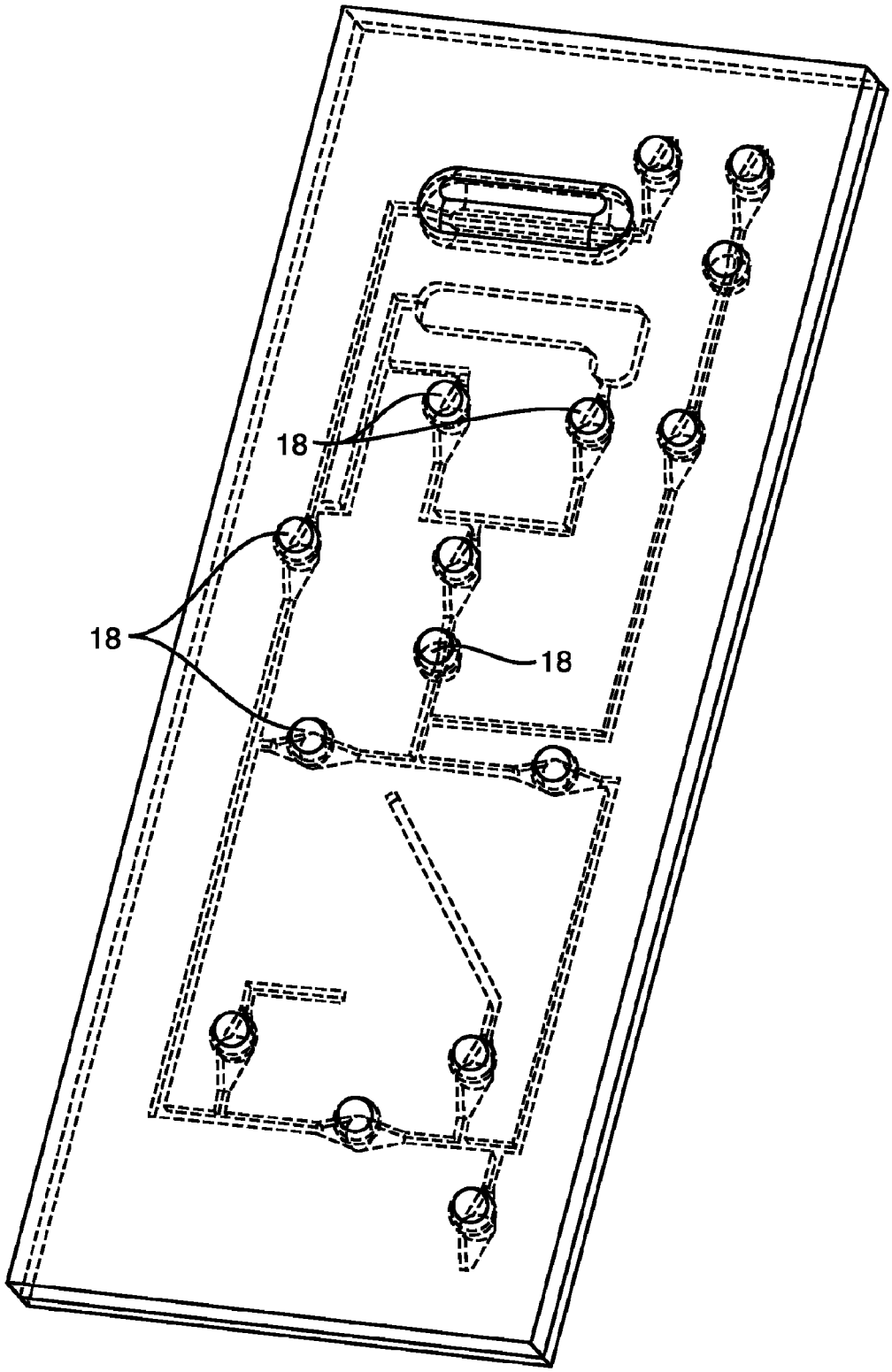
FIG. 5 is a perspective view illustrating a micro-fluidic system having valves with spherical occluding members configured in accordance with one embodiment of the present invention in a closed configuration.

In FIG. 5, the compliant cover surface of the micro-fluidic device is shown with the imbedded balls 18 used to seal the valves and pump the fluids. Various techniques can be used to depress the balls against the valve seat and pump chamber. The complete seal created by the matched contours of the valve seat and compressed compliant layer, combined with the consistent volume of fluid displaced by the pump, assures accurate metering of fluids into the micro-fluidic device. The use of matched contours allows reliable occlusion of the channel with low force on the actuators and minimal strain on the compliant member. Regarding pumps the matched contours assure the force required to move the compliant layer to the matched seat will be minimal and that after contact with the seat the force will rapidly increase to assure consistent pumped volume. The compliance of the layer covering the actuator will allow self centering of the spherical channel segment and conforming actuator surface.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A system for the control of fluid flow in a micro-fluidic system, the system comprising: a substrate; at least one micro-fluidic channel disposed in a microchannel layer atop said substrate; a conformable layer disposed on said micro-fluidic layer; a receiving cavity disposed within said at least one micro-fluidic channel; at least one occluding member disposed within said conformable layer, configured to be received by said receiving cavity so as to occlude said micro-fluidic channel when depressed by an actuator, and wherein said occluding member is configured from a durable material selected from the group of durable materials consisting of metal, ceramic, and engineered plastic.

2. The system of claim 1 wherein said occluding member is of a geometric shape selected from the group of shapes consisting of spheres, cylinders, cones, oblongs, ellipsoids.

3. The system according to claim 1 wherein said receiving cavity is configured to match the shape of said occluding member.

4. The system according to claim 1 wherein said actuator is a cam.

5. The system according to claim 1 wherein said actuator is a linear cam having one or more lobes driven by a linear motor.

6. The system according to claim 1 wherein said actuator is a rotary cam having one or more lobes driven by a linear motor.

7. The system according to claim 1 wherein said actuator is a rotary cam having one or more lobes driven by a rotary motor.

8. The system according to claim 1 wherein said actuator is a linear cam having one or more lobes driven by a rotary motor.

9. A system for pumping micro-fluidic amounts, said system comprising: a first, a second and a third valve system, said second valve system disposed between said first and said third valve system, and said first, second and third valve systems each comprising: a substrate; at least one micro-fluidic channel disposed in a microchannel layer atop said substrate; a conformable layer disposed on said micro-fluidic layer; a receiving cavity disposed within said at least one micro-fluidic channel; and at least one occluding member disposed within said conformable layer, and configured to be received by said receiving cavity so as to occlude said micro-fluidic channel when depressed by an actuator; said first second and third valve systems being disposed upon a common micro-fluidic chamber, such that said first and said third valve systems define a pump chamber, and said receiving cavity of said second valve system defines a pump volume such that said second valve system provides pressure forcing fluid from said pumping chamber, and wherein said occluding member is configured from a durable material selected from the group of durable materials consisting of metal, ceramic, and engineered plastic.

10. The system according to claim 9 wherein said actuator is a linear cam having one or more lobes driven by a linear motor.

11. The system according to claim 9 wherein said actuator is a rotary cam having one or more lobes driven by a linear motor.

12. The system according to claim 9 wherein said actuator is a rotary cam having one or more lobes driven by a rotary motor.

13. The system according to claim 9 wherein said actuator is a linear cam having one or more lobes driven by a rotary motor.

* * * * *

UNITED STATES PATENT AND TRADEMARK OFFICE

CERTIFICATE OF CORRECTION

PATENT NO. : 8,096,786 B2
APPLICATION NO. : 12/394070
DATED : January 17, 2012
INVENTOR(S) : Lamar E. Bullock It is certified that error appears in the above-identified patent and that said Letters Patent is hereby corrected as shown below:

In the Specification

In column 1, lines 12-15 delete the entire paragraph and substitute the following:

--This invention was made with government support under Grant Number EEC-0332597 awarded by the National Science Foundation. The government has certain rights in the invention.--

Signed and Sealed this
Eighth Day of September, 2015

Michelle K. Lee

Michelle K. Lee
*Director of the United States Patent and Trademark Office*